US011559987B2

(12) United States Patent
Martin et al.

(10) Patent No.: US 11,559,987 B2
(45) Date of Patent: Jan. 24, 2023

(54) FLUIDIC DIE WITH SURFACE CONDITION MONITORING

(71) Applicant: Hewlett-Packard Development Company, L.P., Spring, TX (US)

(72) Inventors: Eric Martin, Corvallis, OR (US); Daryl E. Anderson, Corvallis, OR (US); James R. Przybyla, Corvallis, OR (US); Chien-Hua Chen, Corvallis, OR (US); Diane R. Hammerstad, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/058,690

(22) PCT Filed: Jan. 31, 2019

(86) PCT No.: PCT/US2019/016083
§ 371 (c)(1),
(2) Date: Nov. 25, 2020

(87) PCT Pub. No.: WO2020/159517
PCT Pub. Date: Aug. 6, 2020

(65) Prior Publication Data

US 2021/0370668 A1 Dec. 2, 2021

(51) Int. Cl.
*B41J 2/045* (2006.01)
*B41J 2/14* (2006.01)

(52) U.S. Cl.
CPC ..... *B41J 2/04563* (2013.01); *B41J 2/0458* (2013.01); *B41J 2/04581* (2013.01);
(Continued)

(58) Field of Classification Search
CPC ..... B41J 2/1433
See application file for complete search history.

(56) References Cited

U.S. PATENT DOCUMENTS 4,942,408 A 7/1990 Braun
5,604,519 A 2/1997 Keefe et al.
(Continued)

FOREIGN PATENT DOCUMENTS

CN 105939856 A 9/2016
CN 109070592 A 12/2018
(Continued)

OTHER PUBLICATIONS

Jurgen Brunahl, Physics of Piezoelectric Shear Mode Inkjet Actuators, Jun. 2, 2003, Royal Institute of Technology.pdf.

*Primary Examiner* — Shelby L Fidler
(74) *Attorney, Agent, or Firm* — Foley & Lardner LLP

(57) ABSTRACT

One example provides a fluidic die including a nozzle layer disposed on a substrate, the nozzle layer having an upper surface opposite the substrate and including a plurality of nozzles formed therein, each nozzle including a fluid chamber and a nozzle orifice extending through the nozzle layer from the upper surface to the fluid chamber. A conductive trace is exposed to the upper surface of the nozzle layer and extends proximate to a portion of the nozzle orifices, an impedance of the conductive trace indicative of a surface condition of the upper surface of the nozzle layer.

13 Claims, 7 Drawing Sheets

(52) U.S. Cl.
CPC ..... *B41J 2/14016* (2013.01); *B41J 2/1433* (2013.01); *B41J 2/14201* (2013.01)

(56) References Cited

U.S. PATENT DOCUMENTS

| | | | | |
|---|---|---|---|---|
| 8,075,093 | B2 | 12/2011 | Silverbrook et al. | |
| 9,493,002 | B2 | 11/2016 | Edelen et al. | |
| 9,802,406 | B2 | 10/2017 | Nishikawa | |
| 2005/0190232 | A1* | 9/2005 | Lee | B41J 2/161 347/45 |
| 2005/0231545 | A1 | 10/2005 | Benjamin et al. | |
| 2007/0080245 | A1* | 4/2007 | Lin | B41J 2/14201 239/533.1 |
| 2007/0120893 | A1* | 5/2007 | Chou | B41J 2/0451 347/61 |
| 2009/0002427 | A1* | 1/2009 | Min | B41J 2/04563 347/19 |
| 2011/0084997 | A1* | 4/2011 | Chen | B41J 2/14153 347/14 |
| 2013/0070012 | A1* | 3/2013 | Yokouchi | B41J 2/1623 347/14 |

FOREIGN PATENT DOCUMENTS

| | | | |
|---|---|---|---|
| EP | 0565280 | B1 | 4/1994 |
| EP | 0676286 | B1 | 12/1999 |
| EP | 1053879 | A2 | 11/2000 |
| EP | 1125745 | B1 | 7/2008 |
| EP | 1706277 | B1 | 8/2012 |
| TW | 201605306 | A | 2/2016 |
| WO | WO2008073242 | A2 | 6/2008 |
| WO | WO-2016/150939 | A1 | 9/2016 |

* cited by examiner

FLUIDIC DIE WITH SURFACE CONDITION MONITORING

BACKGROUND

Fluidic devices, such as fluidic dies, for example, include a nozzle layer (e.g., an SU8 layer) disposed on a substrate (e.g., silicon). A plurality of nozzles are formed in the nozzle layer, with each nozzle including a fluid chamber formed within the nozzle layer and a nozzle orifice extending from a surface of the nozzle layer to the fluid chamber and from which fluid drops may be ejected from the fluid chamber. Some example fluidic devices may be printheads, where a fluid within the fluid chambers may be ink.

Figure 1:
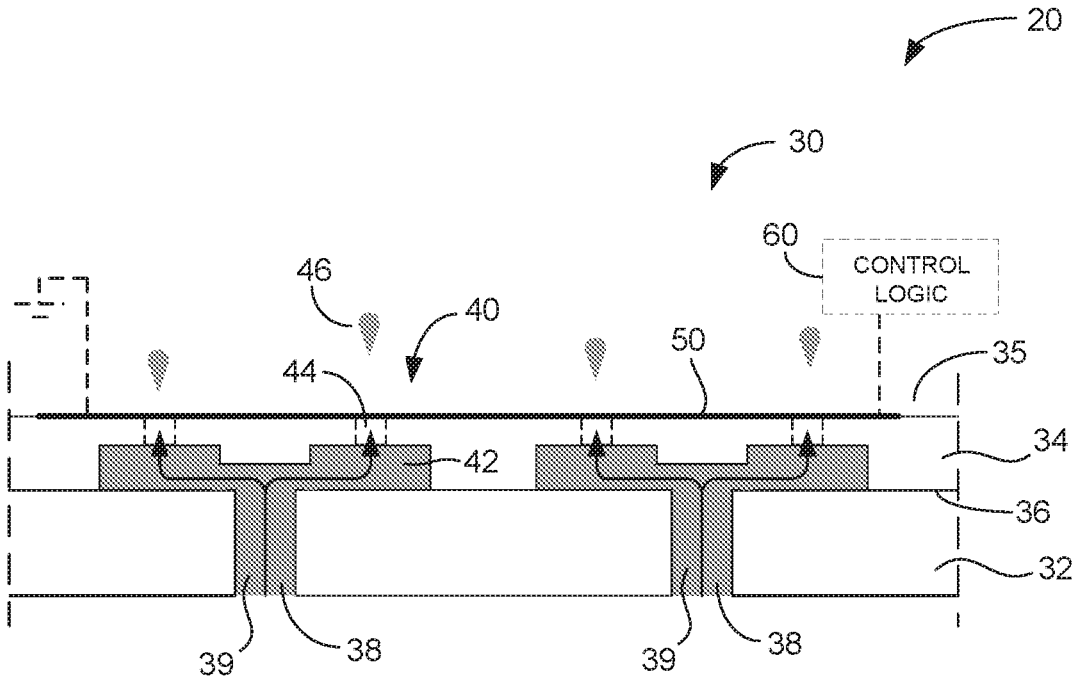
FIG. 1 is a cross-sectional view generally illustrating a fluidic die, according to one example.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Examples of fluidic devices, such as fluidic dies, for instance, may include fluid actuators. Fluid actuators may include thermal resistor based actuators, piezoelectric membrane based actuators, electrostatic membrane actuators, mechanical/impact driven membrane actuators, magnetostrictive drive actuators, or other suitable devices that may cause displacement of fluid in response to electrical actuation. Example fluidic dies described herein may include a plurality of fluid actuators, which may be referred to as an array of fluid actuators. An actuation event or firing event, as used herein, may refer to singular or concurrent actuation of fluid actuators of a fluidic die to cause fluid displacement.

Example fluidic dies may include fluid channels, fluid chambers, orifices, fluid holes, and/or other features which may be defined by surfaces fabricated in a substrate and other material layers of the fluidic die such as by etching, microfabrication (e.g., photolithography), micromachining processes, or other suitable processes or combinations thereof. Some example substrates may include silicon based substrates, glass based substrates, gallium arsenide based substrates, and/or other such suitable types of substrates for microfabricated devices and structures.

As used herein, fluid chambers may include ejection chambers in fluidic communication with nozzle orifices from which fluid may be ejected, and fluidic channels through which fluid may be conveyed. In some examples, fluidic channels may be microfluidic channels where, as used herein, a microfluidic channel may correspond to a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.).

In some examples, a fluid actuator may be arranged as part of a nozzle where, in addition to the fluid actuator, the nozzle includes a fluid chamber in fluidic communication with a nozzle orifice. The fluid actuator is positioned relative to the fluid chamber such that actuation of the fluid actuator causes displacement of fluid within the fluid chamber that may cause ejection of a fluid drop from the fluid chamber via the nozzle orifice. Accordingly, a fluid actuator arranged as part of a nozzle may sometimes be referred to as a fluid ejector or an ejecting actuator.

In one example nozzle, the fluid actuator comprises a thermal actuator, where actuation of the fluid actuator (sometimes referred to as "firing") heats fluid within the fluid chamber to form a gaseous drive bubble therein, where such drive bubble may cause ejection of a fluid drop from the fluid chamber via the nozzle orifice (after which the drive bubble collapses). In one example, the thermal actuator is spaced from the fluid chamber by an insulating layer. In one example, a cavitation plate may be disposed within the fluid chamber, where the cavitation plate is positioned to protect material underlying the fluid chamber, including the underlying insulating material and fluid actuator, from cavitation forces resulting from generation and collapse of the drive bubble. In examples, the cavitation plate may be metal (e.g., tantalum). In some examples, the cavitation plate may be in contact with the fluid within the fluid chamber.

In some examples, a fluid actuator may be arranged as part of a pump where, in addition to the fluidic actuator, the pump includes a fluidic channel. The fluidic actuator is positioned relative to the fluidic channel such that actuation of the fluid actuator generates fluid displacement in the fluid channel (e.g., a microfluidic channel) to convey fluid within the fluidic die, such as between a fluid supply (e.g., fluid slot) and a nozzle, for instance. A fluid actuator arranged to convey fluid within a fluidic channel may sometimes be referred to as a non-ejecting actuator. In some examples, similar to that described above with respect to a nozzle, a metal cavitation plate may be disposed within the fluidic channel above the fluid actuator to protect the fluidic actuator and underlying materials from cavitation forces resulting from generation and collapse of drive bubbles within the fluidic channel.

Fluidic dies may include an array of fluid actuators (such as columns of fluid actuators), where the fluid actuators of the array may be arranged as fluid ejectors (i.e., having corresponding fluid ejection chambers with nozzle orifices) and/or pumps (having corresponding fluid channels), with selective operation of fluid ejectors causing fluid drop ejection and selective operation of pumps causing fluid displacement within the fluidic die.

Fluidic dies may include a nozzle layer (e.g., an SU8 photoresist layer) disposed on a substrate (e.g., a silicon substrate) with the fluid chamber and nozzle orifice of each nozzle being formed in the nozzle layer. In one example, the SU8 layer has first surface (e.g., a lower surface) disposed on the substrate (facing the substrate), a second surface (e.g., an upper surface) opposite the first surface (facing away from the substrate). In one example, the fluid chambers with a corresponding nozzle orifice extending through the nozzle layer from the upper surface to each fluid chamber, where fluid drops may be ejected from each fluid chamber via the corresponding nozzle orifice. The fluid may comprise any number of fluid types including ink and biological fluids, for example.

During operation of the fluidic die, operating conditions at the upper surface of the nozzle layer can impact ejection of fluid drops from the nozzles. For example, fluid (e.g., ink) may puddle on the upper surface about a nozzle orifice and interfere with ejection of fluid from such nozzle orifice or from adjacent nozzle orifices, where such puddling may be the result of nozzle operational issues, such as damage to the nozzle layer, for example. Surface temperatures of the nozzle layer may also impact fluid ejection and, in some cases, may result in solidification of fluids which can obstruct nozzle orifices or result in a variation in properties in ejected drops.

Present techniques for monitoring nozzle operating conditions include drop detection techniques (e.g., electrical and optical), and scanning printed output for defects, for example. However, drop detection techniques are limited in the types of defects that are detectable, and scanning printed output is time consuming and expensive. Thermal sensors may also be employed, but such sensors are locating in wiring layers below the nozzle layer such that sensed temperatures represent an approximation of surface temperatures based on known thermal characteristics of the overlying material.

According to examples of the present disclosure, conductive traces are disposed so as to be exposed at the upper surface of the nozzle layer (e.g., disposed on the upper surface or partially embedded within the nozzle layer), wherein an electrical property of the conductive traces (e.g., impedance) is indicative of surface conditions of the upper surface of the nozzle layer (e.g., temperature, and presence of fluid, particles, or other surface contaminants).

FIG. 1 is a cross-sectional view generally illustrating portions of a fluidic device 20, such as a fluidic die 30, including a conductive trace exposed at an upper surface of a nozzle layer, in accordance with examples of the present disclosure, where an electrical property (e.g., impedance, resistance) of the conductive trace is indicative of a surface condition of the upper surface of the nozzle layer, such as a temperature and a presence of fluid, for example. According to the example of FIG. 1, fluidic die 30 includes a substrate 32, such as a silicon substrate, with a nozzle layer 34 disposed thereon. In one example, nozzle layer 34 has a lower surface 36 (e.g., a first surface) disposed on substrate 32, and an opposing upper surface 35 (e.g., a second surface). In one example, nozzle layer 34 comprises an SU-8 material.

Nozzle layer 34 includes a plurality of nozzles formed therein, such as illustrated by nozzle 40, with each nozzle 40 including a fluid chamber 42 disposed within nozzle layer 34 and a nozzle orifice 44 extending through the nozzle layer 34 from upper surface 35 to fluid chamber 42. In one example, substrate 32 includes a plurality of fluid feed holes 38 to supply fluid 39 (e.g., ink) from a fluid source to fluid chambers 42 of nozzles 40 (as illustrated by the arrows in FIG. 1). In other examples, nozzles 40 may receive fluid from a fluid slot. In operation, nozzles 40 selectively eject fluid drops 46 from fluid chamber 42 via nozzle orifices 44 (see FIGS. 2A-2D below).

As described above, during operation, surface conditions at the upper surface 35 of nozzle layer 34 may adversely impact ejection of fluid drops 46 from nozzles 40. In one example, fluidic die 30 includes a conductive trace 50 disposed so as to be exposed to the upper surface 35 of nozzle layer 34, where an electrical property of conductive trace 50 of an operating condition at upper surface 35. In one case, an impedance of conductive trace 50 is periodically measured, where the measured impedance of conductive trace 50 is indicative of fluid puddling on upper surface 35 (e.g., a measured impedance value less than an expected value). In another case, the measured impedance of conductive trace 50 is indicative of a temperature of upper surface 35 of nozzle layer 34 (e.g., conductive trace 50 comprises a thermal resistor having a temperature dependent resistance). While described primarily in terms of an impedance, it is noted that, in other examples, a resistance of conductive trace 50 may be monitored to determine a surface operating condition.

In one example, as illustrated in FIG. 1, conductive trace 50 may be disposed on upper surface 35 of nozzle layer 34. In other examples, conductive trace 50 may be disposed partially within the nozzle layer such that at least an upper surface of conductive trace 50 is exposed at upper surface 35 (e.g., an upper surface of conductive trace 50 is flush with upper surface 35). In one example, conductive trace 50 extends proximate to a portion of nozzle orifices 44. In one example, conductive trace 50 is a continuous conductive trace extending around a group of nozzles (e.g., FIGS. 4-6). In other examples, conductive trace 50 may comprise a pair of conductive traces extending along each side of a group (e.g., a column) of nozzles 40 (e.g., FIG. 7). In some implementations, conductive traces 50 may partially circumscribe nozzle orifice 44, thereby increasing a sensitivity of detection of the conductive traces. Conductive trace 50 may be made of any suitable conductive material, including Al, Cr/Au, Ta, Ti, and doped polysilicon, for example.

In one example, control logic 60 may be electrically connected to conductive trace 50 for monitoring the corresponding electrical property thereof. In one example, control logic 60 may be external to fluidic die 30 (e.g., as part of a printer controller), as indicated by the dashed lines in FIG. 1. In other cases, control logic 60 may be integrated within fluidic die 30, such as an integrated circuit within substrate 32, for example (e.g., see FIG. 3).

By periodically monitoring an electrical property of a conductive trace 50 which is exposed at upper surface 35 of nozzle layer 34, an operating condition at upper surface 35, such as the presence of fluid puddling and temperature, for example, can be monitored in real time. Such real time monitoring enables early detection of potential damage and malfunctioning of fluidic die 30, thereby enabling defective components to be quickly identified and addressed which, in-turn, reduces downtime and potentially reduces an amount of defective output (e.g., printed output).

FIGS. 2A-2D are cross-sectional views generally illustrating a nozzle 40, according to one example, and generally illustrating ejection of a fluid drop therefrom. Nozzle 40 of FIGS. 2A-2D includes a thermal actuator 70, such as a thermal resistor, for example, to vaporize fluid to form a drive bubble within fluid chamber 42 to eject a drop 46 during a firing event. In the illustrated example, nozzle 40 further includes a cavitation plate 72 disposed on a bottom surface of fluid chamber 42 so as to be positioned above thermal actuator 70. As mentioned above, cavitation plate 72 protects thermal actuator 70 and material underlying fluid chamber 42 from cavitation forces created by drive bubble collapse.

Figure 2A:
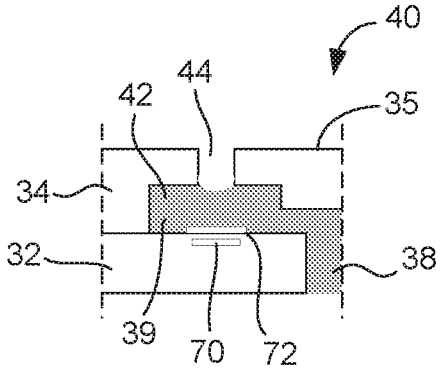
FIGS. 2A-2D generally illustrate ejection of a fluid drop from a fluidic die, according to one example.
Figure 2B:
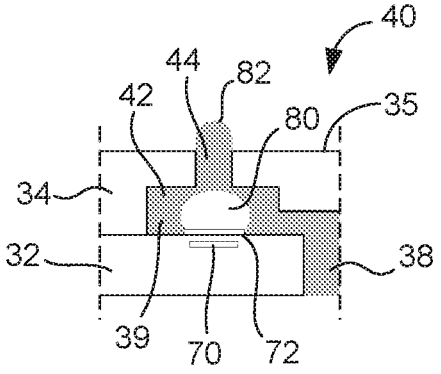

With reference to FIG. 2A, prior to an actuation event, when thermal actuator 70 is not energized, fluid chamber 42 is filled with fluid 39, such as ink for example. Upon initiation of an actuation event, as illustrated by FIG. 2B thermal actuator 70 is energized and begins heating fluid 39, causing vaporization of at least a portion of a component of fluid 39 (e.g., water) and to begin formation of a vapor or drive bubble 80 within fluid chamber 42, where the expanding drive bubble 80 begins to force a portion 82 of fluid 39 from fluid chamber 42 via nozzle orifice 44.

Figure 2C:
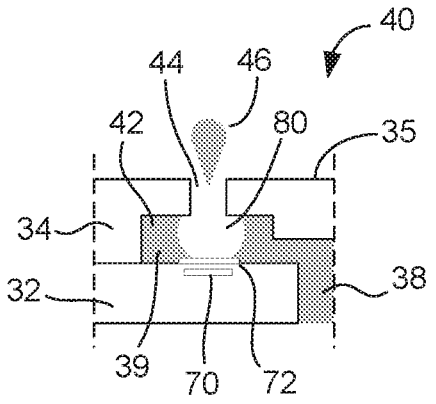
Figure 2D:
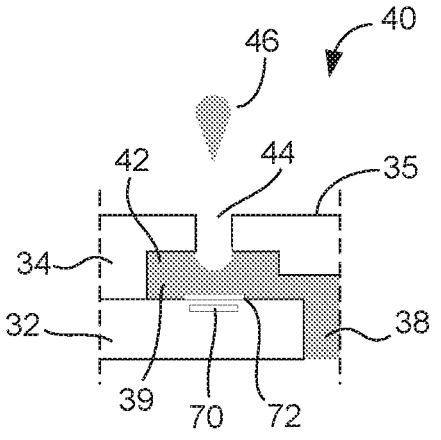

With reference to FIG. 2C, as thermal actuator 70 continues to heat fluid 39, drive bubble 80 continues to expand until it escapes from nozzle orifice 44 and expels portion 82 of fluid 39 therefrom in the form a fluid drop 46. With reference to FIG. 2D, upon ejection of fluid drop 46, thermal actuator is de-energized and drive bubble 80 collapses as fluid drop 46 continues to move away from nozzle orifice 44. Upon completion of the firing event, nozzle 40 returns to a state as illustrated by FIG. 2A.

As described above, if nozzle layer 34 becomes damaged, such damage may adversely impact the ability of nozzles 40 to properly eject fluid drops 46, and may cause leakage and puddling of fluid 39 on upper surface 35 of fluidic die 30. Fluid puddling may also result from a particle or other obstruction on upper surface 35 interacting or interfering with ejected fluid drops 46, and from unsuitable operating conditions (e.g., improper power provided to a fluid actuator or improper actuation timing).

Figure 3:
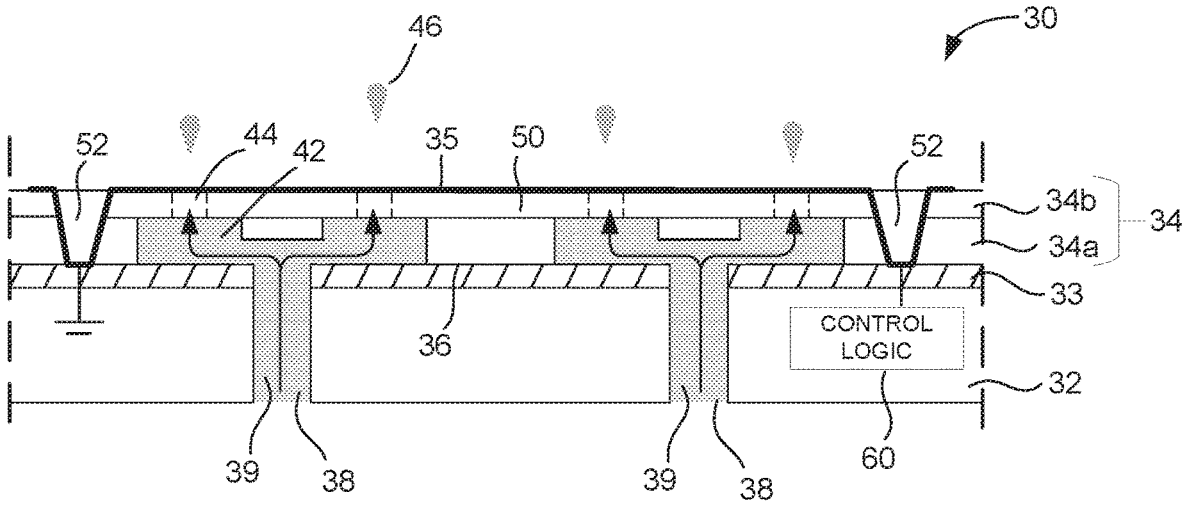
FIG. 3 is a cross-sectional view generally illustrating a fluidic die, according to one example.

FIG. 3 is a cross-sectional view generally illustrating portions of fluidic die 30, in accordance with one example of the present application. According to the example of FIG. 3, a thin film layer 33, including a plurality of structured metal wiring layers, is disposed between nozzle layer 34 and substrate 32. Additionally, nozzle layer 34 includes multiple layers, including a chamber layer **34*a* in which fluid chamber 42 are formed, and a nozzle orifice layer 34*b* in which nozzle orifices 44** are formed.

According to the example of FIG. 3, conductive trace 50 is disposed on upper surface 35 of nozzle layer 34 (i.e., on top of chamber **34*a*). In other cases, conductive trace 50 may be partially embedded within nozzle layer 34 so at to be at least partially exposed at upper surface 35. In one example, as illustrated, conductive trace 50 is electrically connected at each end to metal layers within thin film layer 33 by vias 54 extending through chamber layer 34*a* to thin film layer 33, with a first end and an opposing second end of conductive trace 50 being respectively connected to control logic 60 integral to substrate 32 and to a reference potential (e.g., ground) by way of thin film layer 33**.

In one example, control logic 60 monitors an impedance of conductive trace 50 by injecting a fixed current through conductive trace 50 with a resulting voltage being representative of the impedance. In other cases, control logic 60 applies a fixed voltage to conductive trace 50 with a resulting current being representative of the impedance of conductive trace 50. In one example, control logic 60 may compare the measured impedance of conductive trace 50 to a set of known impedances which correlate to a temperature of conductive trace 50 and, thus, to a temperature at surface 35 of nozzle layer 34. In another case, control logic 60 may compare the measured impedance of conductive trace 50 to a set of known impedances indicative of fluid puddling on upper surface 35 and, in one example, indicative of a particular nozzle about which the fluid is puddling.

FIGS. 4-7 each generally illustrate a top view of a portion of fluidic die 30, and generally illustrate example implementations of conductive trace 50 on upper surface 35 of nozzle layer 34. In each of the FIGS. 4-7, a plurality of nozzle orifices 44 (and thus nozzles 40) are arranged to form a column 43 of nozzle orifices 44. It is noted that FIGS. 4-7 are for illustrative purposes only, and that fluid die 30 may include more than one column 43 of nozzles orifices 44, and that each column 43 may include more or few nozzle orifices 44 than illustrated, or the nozzle orifices 44 may have physical arrangements other than columns.

Figure 4:
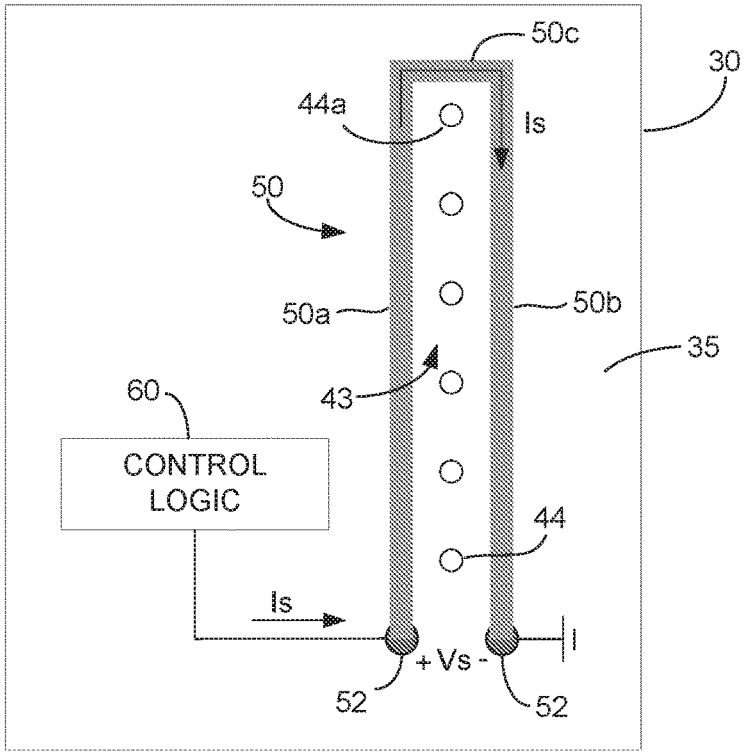
FIG. 4 is a top view generally illustrating an arrangement of a conductive trace, according to one example.

In the example of FIG. 4, conductive trace 50 continuously extends about column 43 of nozzle orifices 44, with first and second longitudinal segments **50*a* and 50*b* extending on opposite sides of column 43 and being connected to one another by a lateral segment 50*c* beyond a final nozzle orifice 44*a* of the column of nozzles orifices monitored by conductive trace 50. In some examples, which are not illustrated, column 43 of nozzle orifices 44 may extend beyond lateral segment 50*c*, with other portions of column 43 being monitored via additional conductive traces 50. In one example, as illustrated, a first end of conductive trace 50 is connected to control logic 60 (e.g., within substrate 32) and an opposing second end is connected to ground by respective vias 52 through nozzle layer 34 and wiring layer 33 (see FIG. 3, for example). In other examples, first and second ends of conductive trace 50 may each be coupled to control logic 60**.

According to one example, in operation, control logic 60 injects a fixed sense current, Is, through conductive trace 50 and measures a resulting sense voltage, Vs, across conductive trace 50 to measure the impedance thereof. According to one example, control logic 60 compares the measured impedance of conductive trace 50 to a set of known values of conducive trace 50, where a measure impedance within a first range of known impedances is indicative of a temperature of conductive trace 50, and thus a temperature at upper surface 35 of nozzle layer 34, and a measured impedance with a second range of known impedances is indicative of whether fluid puddling is present on upper surface 35 (see FIG. 5 below).

Figure 5:
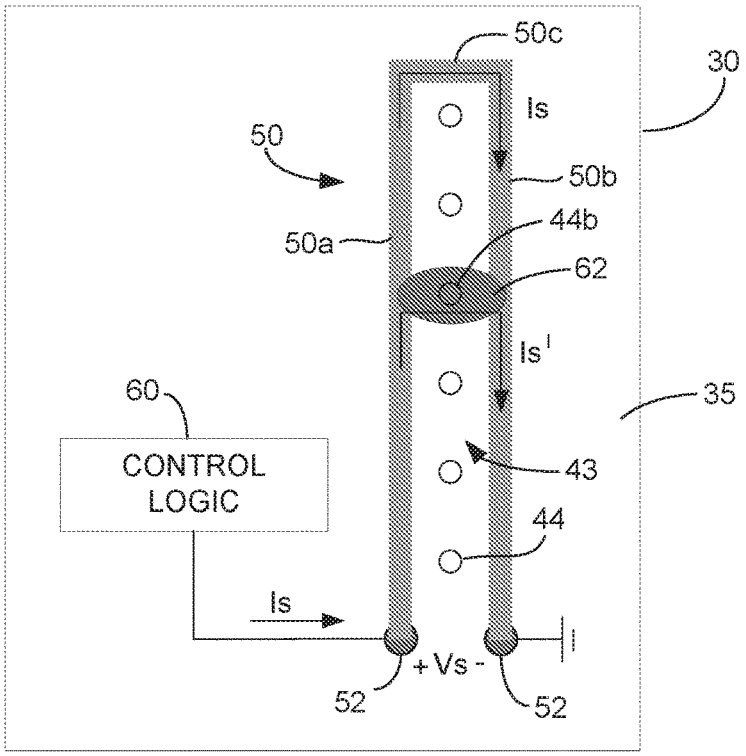
FIG. 5 is a top view generally illustrating an arrangement of a conductive trace, according to one example.

FIG. 5 illustrates the implementation of FIG. 4 and demonstrates the operation of conductive trace 50 for the detection of fluid puddling on upper surface 35. In FIG. 5, a puddle 62 of fluid (e.g., ink) is illustrated as having formed about a nozzle orifice **44*b*. As described above, such a puddle 62 may form as a result of malfunction related to the nozzle 40 of which nozzle orifice 44*b* is a part. As illustrated, upon puddle 62 becoming large enough to span a distance between first and second longitudinal segments 50*a* and 50*b* of conductive trace 50, a short circuit is created between first and second conductive segments 50*a* and 50*b***.

During periodic monitoring, when control logic 60 impresses a known sense current, Is, through conductive trace 50, in addition to flowing through lateral segment 50*c* beyond the final nozzle orifice 44*a*, the sense current will also flow between first and second longitudinal segments 50*a* and 50*b* via puddle 62, as indicated by the arrow Is'. As a consequence, the resulting sense voltage, Vs, across conductive trace 50 as measured by control logic 60 will be less than an expected value, such that the measured impedance will be less than an expected value, indicating that a puddle is present about at least one of the nozzle orifices 44. In one example, based on a magnitude of measured impedance, control logic 60 can determine the nozzle orifice 44 about which puddle 62 has formed.

In other examples, conductive trace 50 can be employed to check an operation of selected nozzles 40. For instance, with additional reference to FIGS. 2A-2D, fluid may be pumped into selected a nozzles 40 to "prime" the selected nozzles with fluid. In one example, such selected nozzles may be "over primed" such that a puddle 62 forms about the corresponding nozzle orifice, with detection of such puddle 62 by conductive trace 50 and control logic 60 providing verification that the selected nozzle is functional and has been primed.

Figure 6:
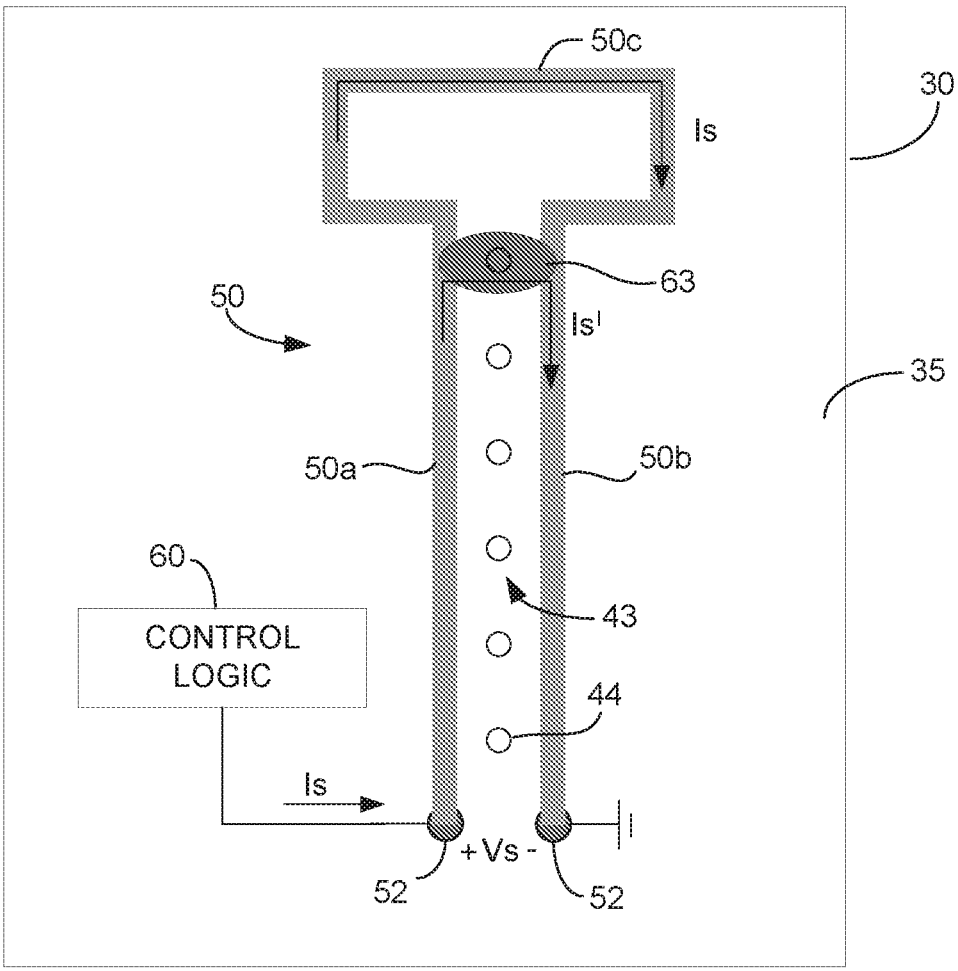
FIG. 6 is a top view generally illustrating an arrangement of a conductive trace, according to one example.

With reference to FIG. 6, according to one example, in order to differentiate between a normal sense current, Is, flowing through lateral segment 50*c* (such as illustrated by FIG. 4) and sense current, Is', flowing through a puddle 63 about the final nozzle orifice 44*a*, lateral segment 50*c* of conductive trace 50 is extended beyond final nozzle orifice 44*a* to increase an impedance of conductive race 50. In one example, as illustrated, the length of lateral conductive segment 50*c* is increased by disposing lateral segment 50*c* in the form of a loop. It is noted that any suitable configuration may be used to increase the length of lateral conductive segment 50*c*. In this way, sense current, Is, flowing through conducive segment 50*c* will indicate a measured impedance detectably greater than an impedance measured if the sense current is flowing though puddle 63, as indicated by sense current path, Is'. As such, a length of lateral conductive segment 50*c* is selected to increase a signal-to-noise ratio of a measured electrical property of conductive trace 50 so that a presence of a fluid puddle proximate to last nozzle orifice 44*b* is readily distinguishable from an absence of a fluid puddle.

In the example implementations of FIGS. 4-6, it is noted that conductive trace 50 may be used to both measure a temperature of upper surface 35 of nozzle layer 34, and to detect a presence of fluid on upper surface 35. In addition to the presence of fluid, it is noted that conductive trace 50 may also detect the presence of other undesirable surface conditions, such as the presence of conductive particles or contaminants on upper surface 35 that bridge a gap between segments of conductive trace 50. In response to detecting such undesirable surface conditions, actions may be initiated to remedy the situation (such as surface wiping and additional fluid ejection or "spitting" from affected nozzles, for example), where a selected remedy may depend on the measured impedance level, or instance.

Figure 7:
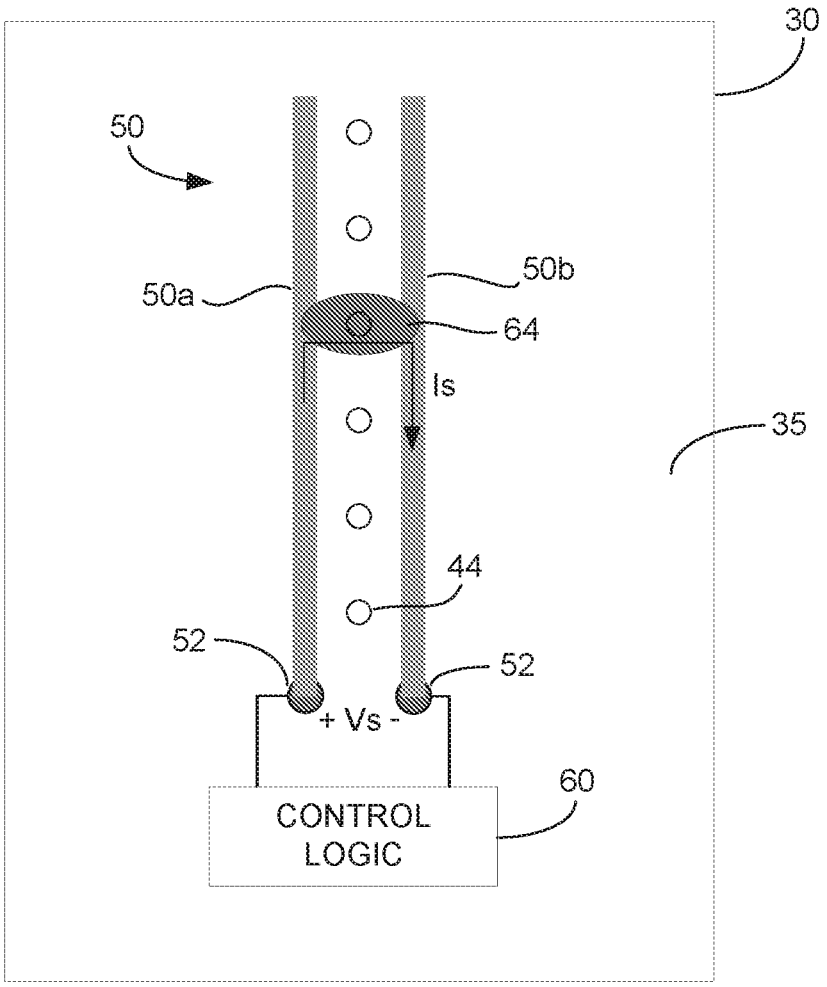
FIG. 7 is a top view generally illustrating an arrangement of a conductive trace, according to one example.

With reference to FIG. 7, according to one example, in lieu of a continuous conductive trace 50, conductive trace 50 includes only longitudinally extending conductive segments 50*a* and 50*b* extending along opposite sides of column 43 of nozzle orifices 44. According to one example, to detect a presence of fluid on upper surface 35, control logic 60 applies sense voltage, Vs, across conductive segments 50*a* and 50*b* and detects a presence of a resulting sense current, Is. If no sense current is detected, fluid is not present on upper surface 35. A detected sense current, Is, indicates of a fluid puddle 64 on upper surface 35 extending between conductive segments 50*a* and 50*b*, with a magnitude of the measured sense current, Is, or a magnitude of an impedance derived therefrom, indicating which nozzle orifice 44 corresponds to the detected fluid puddle 64. In one example, as described above, control logic 60 compares a measured sense current (or impedance value) to a stored table of known, expected values for such electrical properties.

It is noted that the configurations of FIGS. 4-7 are for illustrative purposes, and that any number of potential configurations of conductive traces 50 are possible. For instance, in other examples, conductive trace 50 may be disposed along only one side of column 43. Also, although illustrated in terms of only one conducive trace 50, in other examples, any number of conductive traces 50 may be employed, with each conductive trace 50 providing monitoring for a different portion of upper surface 35, including different portions of nozzle orifices 44. Additionally, by integrating control logic 60 within substrate 32, control logic 60 and conductive traces 50 together provide fluidic die 32 with integral surface monitoring of upper surface 35. In other examples, monitoring circuitry 60 may be disposed remotely from fluidic die 32 (see FIG. 8, for example).

Figure 8:
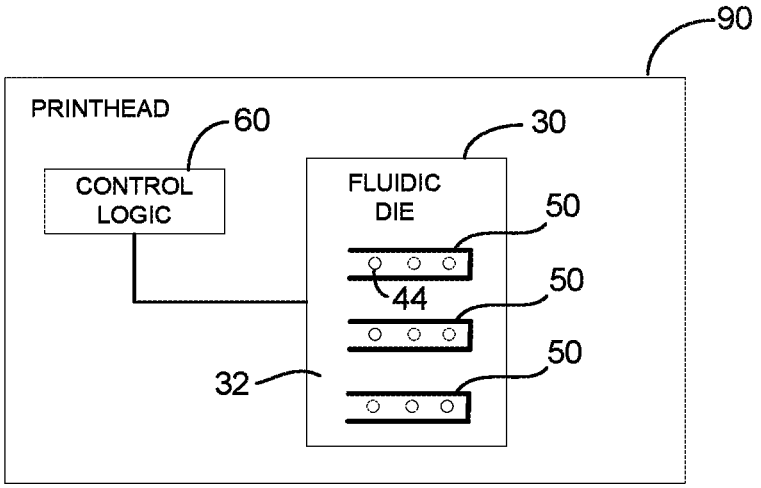
FIG. 8 is a block and schematic diagram generally illustrating a printhead including a fluidic die, according to one example.

FIG. 8 is a block and schematic diagram generally illustrating a printhead 90 including a fluidic die 30 having a plurality of conductive traces 50 exposed to surface 35 of nozzle layer 32 and disposed about columns of nozzle orifices 44, and further including control logic 60 disposed external to fluidic die 30, according to one example of the present disclosure. In other examples, control logic 60 may be integrated within fluidic die 30. In other examples, printhead 90 may include multiple fluidic die 30, with externally disposed monitoring circuitry 60 to monitor an electrical property of conductive traces 50 of each of the fluidic die 30. In other examples, printhead 90 may be part of a printer, where printhead 90 provides indication of a status of conductive traces 50 and fluidic die 30 to the printer.

Figure 9:
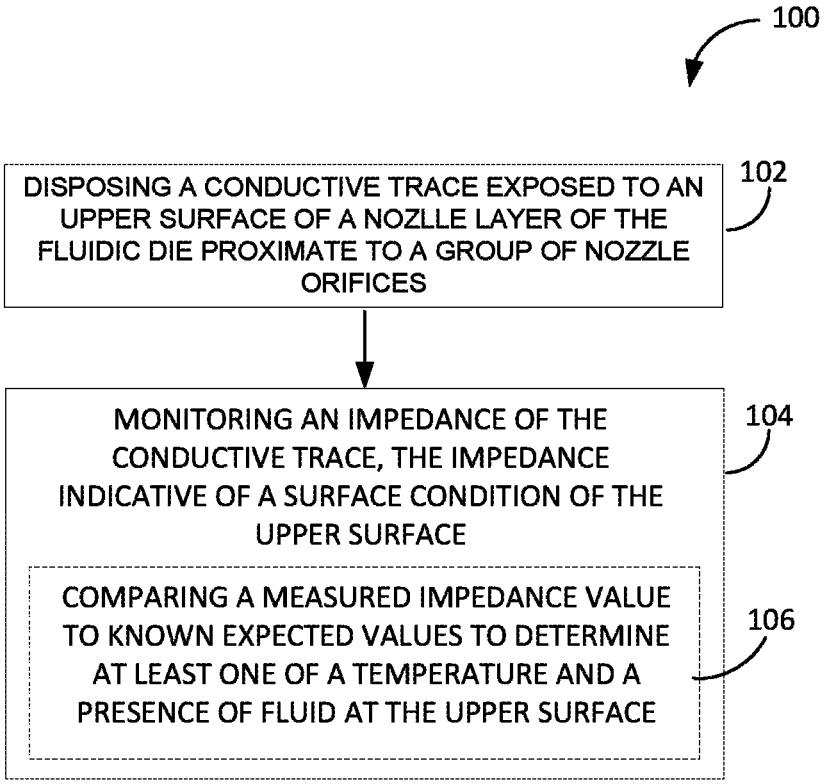
FIG. 9 is a flow diagram generally illustrating a method of monitoring surface conditions of a nozzle layer, according to one example.

FIG. 9 is a flow diagram generally illustrating an example of a method 100 of monitoring surface conditions of a fluidic die, such as fluidic die 30 of FIGS. 1 and 3, for instance. At 102, method 100 includes disposing a conductive trace exposed to an upper surface of a nozzle layer of the fluidic die, the conductive trace extending proximate to a group of nozzle orifices of a plurality of nozzles formed in the nozzle layer, such as conductive trace 50 disposed on upper surface 35 of nozzle layer 34 proximate to nozzle orifices 44, as illustrated by FIGS. 1 and 3. In example, as illustrated by FIGS. 4-6, for instance, conductive trace 50 may be disposed along both sides of a column 43 of nozzle orifices 44.

At 104, method 100 includes monitoring an impedance of the conductive trace, the impedance indicative of a surface condition at the upper surface of the nozzle layer, such as control logic 60 monitoring an impedance value of conductive trace 50 of FIG. 3, for example. In one example, as illustrated at 106, monitoring the impedance of conductive trace 50 included comparing a measured impedance value to known expected impedance values (e.g., a table of impedance values) to determine at least one of a temperature and a presence of fluid at the upper surface of the nozzle layer, such as described by FIGS. 4-6, or instance.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A fluidic die comprising:

a substrate;

a nozzle layer disposed on the substrate, the nozzle layer having an upper surface opposite the substrate and including a plurality of nozzles formed therein, each nozzle including a fluid chamber and a nozzle orifice extending through the nozzle layer from the upper surface to the fluid chamber;

a conductive trace exposed to the upper surface of the nozzle layer and extending proximate to and spaced from a portion of the nozzle orifices; and control logic to monitor impedance of the conductive trace, and to compare the monitored impedance to known expected impedance values to determine a temperature and a presence of fluid at the upper surface of the nozzle layer.

2. The fluidic die of claim 1, the conductive trace extending along opposite sides of the portion of nozzle orifices.

3. The fluidic die of claim 1, the portion of nozzle orifices comprising a column of nozzles.

4. The fluidic die of claim 1, the conductive trace embedded within the nozzle layer with a portion exposed to the upper surface.

5. The fluidic die of claim 1, the conductive trace disposed on the upper surface of the nozzle layer.

6. The fluidic die of claim 1, an impedance of the conductive trace indicating a presence of a fluid puddle on the upper surface which is simultaneously in contact with the conductive trace on each side of a column of nozzle orifices.

7. The fluidic die of claim 1, the conductive trace having a temperature-dependent resistance indicative of the temperature of the upper surface of the nozzle layer.

8. The fluidic die of claim 1, the impedance of the conductive trace in a first range indicating a temperature of the upper surface and in a second range indicating a presence of fluid on the upper surface.

9. The fluidic die of claim 1, the conductive trace including:

a first segment and a second segment extending on opposite sides of the portion of nozzle orifices; and a third segment extending laterally to and joining the first and second segments to form a continuous conductive trace.

10. The fluidic die of claim 9, the third segment having a length selected to increase a signal-to-noise ratio of an electrical property of the conductive trace.

11. A printhead comprising:

a fluidic die including:

a substrate;

a nozzle layer disposed on the substrate and having an upper surface opposite the substrate, the nozzle layer including a plurality of nozzles formed therein, each nozzle including a fluid chamber and a nozzle orifice extending through the nozzle layer from the upper surface to the fluid chamber; and a conductive trace exposed to the upper surface of the nozzle layer and extending proximate to and spaced from a portion of the nozzle orifices; and a monitoring circuit to monitor an impedance of the conductive trace, and to compare the monitored impedance to known expected impedance values to determine a temperature and a presence of fluid at the upper surface of the nozzle layer.

12. A method of monitoring a fluidic die including:

disposing a conductive trace exposed to an upper surface of a nozzle layer of a fluidic die, the conductive trace extending proximate to and spaced from a group of nozzle orifices of a plurality of nozzles formed in the nozzle layer;

monitoring an impedance of the conductive trace; and comparing the monitored impedance to known expected impedance values to determine a temperature and a presence of fluid at the upper surface of the nozzle layer.

13. The method of claim 12, wherein known expected impedance values in a first range are indicative of the temperature, and known expected impedance values in a second range are indicative of the presence of fluid.

* * * * *